US006390640B1

(12) United States Patent
Wong et al.

(10) Patent No.: US 6,390,640 B1
(45) Date of Patent: May 21, 2002

(54) LIGHTED MASK FOR UNDERWATER DIVERS

(75) Inventors: Kevin Wong, Hayward; Ralph Osterhout, San Francisco, both of CA (US)

(73) Assignee: American Underwater Products Inc., San Leandro, CA (US)

( * ) Notice: Subject to any disclaimer, the term of this patent is extended or adjusted under 35 U.S.C. 154(b) by 0 days.

(21) Appl. No.: 09/610,791

(22) Filed: Jul. 6, 2000

(51) Int. Cl.[7] ..... F21V 21/084

(52) U.S. Cl. ..... 362/105; 362/230; 362/191; 362/184; 362/185; 362/234; 362/800; 362/158; 351/43; 351/148

(58) Field of Search ..... 362/105, 230, 362/191, 184, 185, 234, 800, 158; 351/43, 148; 2/209.13

(56) References Cited

U.S. PATENT DOCUMENTS

| | | | | |
|---|---|---|---|---|
| 4,254,451 A | | 3/1981 | Cochran | |
| 4,697,374 A | * | 10/1987 | Simms | 43/17.5 |
| 5,224,772 A | | 7/1993 | Fustos | |
| 5,767,932 A | * | 6/1998 | Gorden | 362/158 |

OTHER PUBLICATIONS

Internet U.S. Patent Extract 5622422.

* cited by examiner

*Primary Examiner*—Stephen Husar
*Assistant Examiner*—Guiyoung Lee
(74) *Attorney, Agent, or Firm*—Bruce & McCoy; Ernest H. McCoy

(57) ABSTRACT

A lighted mask for underwater divers utilizing a monochromatic blue-green LED light source secured to the mask directing light to the front of the face plate of the mask and having a push button control mounted on the mask for actuating the light source.

10 Claims, 3 Drawing Sheets

LIGHTED MASK FOR UNDERWATER DIVERS

BACKGROUND OF THE INVENTION

1. Field of the Invention

The present invention relates to a method and apparatus for providing a lighted mask for underwater divers by utilizing a blue green light for greater depth penetration of underwater illumination in sea water. More particularly it relates to a lighted dive mask using light emitting diodes (LEDs) as a monochromatic light source for providing blue green spectrum illumination.

2. Description of the Prior Art

Lighted dive masks have been utilized in past attempts to provide illumination for underwater divers to read their gauges. An example is U. S. Pat. No. 5,224,772, issued Jul. 6, 1993, to Vincent E. Fustos for an illuminated dive mask. Listed in that patent are other patents relating to lighted dive masks.

The problem with attempting to provide illumination for divers underwater is related in part to the factor of light transcissivity in the medium. Sea water, where most critical underwater diving visibility occurs, absorbs electromagnetic radiation whereby it attenuates light. Research has shown that approximately 60 percent of light is absorbed in the first meter of sea water depth; that 80 percent is absorbed in the first 10 m; and 99 percent is absorbed in the first 150 m. Longer wavelengths (red end) are absorbed preferentialy. Shorter wavelength's (blue—green) are transmitted deeper (farther). That is why sea water appears blue green at depth: the observer sees what is reflected back to h is or her eyes. Clear water is penetrated deeper by light because there is less reflection absorption by particles in the water. It has been determined that the "optical window" or wavelength of light that penetrates sea water the farthest is 543 nanometers (nm): that specific wavelength of light propagates farthest through sea water.

An underwater light source that is "white" (producing red, green, and blue wavelength output) wll give the most natural color rendition of the objects viewed. It requires a substantial amount of energy to produce adequate illumination underwater from a "white light" source. This level of light cannot be achieved by the illuminated dive mask disclosed in the prior art patent to Fustos and similar devices: the available power sources which can be carried in a dive mask are insufficient to create the energy required for sufficient underwater fight penetration.

Light from a monochromatic light source, such as a light emitting diode (LED), can produce efficient and adequate illumination for a diver in the green region due to the photopic responsiveness of the human eye. The monochromatic light source wavelength range most suitable for underwater illumination purposes is 520–560 nm. Very recently LED's have been manufactured that produce a typical wavelength output very close to the "optical window" of sea water. Thus, their output will penetrate se a water the farthest. The present invention utilizes these newly developed LEDs of a specific wavelength, both in a continuous on condition and in an intermittent hashing condition, to provide a monochromatic light source for underwater illumination.

Reference is made to U.S. Pat. No. 4,254,451, issued Mar. 3, 1981, to James A. Cochran for a sequentially flashing device for personal ornamentation. While not related to underwater dive masks, light emitting diodes are used in eyeglass frames as decorative apparatus surrounding a persons eyes. Employing sequential flashing LED's obviously does not teach the use of LED's of any type for underwater illumination, let alone make obvious the specific wavelengths required for sea water light penetration.

SUMMARY OF THE INVENTION

The present invention is a lighted mask for underwater divers. It i s comprised of a frame for supporting a view lens and for positioning the mask on a diver's face and enclosing the diver's eyes. An LED light source is mounted on the frame of the mask which is capable of emitting monochromatic light between 425 and 575 nm. Light emitted from the LED is directed to the area in front of the mask whereby light from the source is focused in the direction the mask wearer is looking. A power source is mounted in the mask for the light source and electrically connected thereto. A diver operable switch means is mounted in the mask for electrically connecting the light source to the power source and for controlling the on and off status of the light source.

OBJECTS OF THE INVENTION

It is therefore an important object of the present invention to provide a mask for underwater divers which utilizes light emitting diodes for providing underwater illumination.

It is another object of the present invention to provide a lighted mask for underwater divers which provides monochromatic light in the blue green spectrum.

It is a further object of the present invention to provide a lighted mask for underwater divers which provides the greatest amount illumination for the smallest power requirement.

It is still another object of the present invention to provide a lighted mask for underwater divers in which the illumination source is self-contained and can be utilized as a signaling device to other divers.

And it is yet a further object of the present invention to provide a lighted mask for underwater divers in which the illumination source can be actuated to on, intermittent operation, or off by a push button switch formed integral to the mask.

Other objects and advantages of the present invention will become apparent when the apparatus and method of the present invention are considered in conjunction with the accompanying drawings.

DESCRIPTION OF THE PREFERRED EMBODIMENT

The present invention is a lighted mask for underwater divers. Another part of the problem with respect to underwater illumination is related to light sensitivity of the human eye. It has been determined that the human visual system can detect the light spectrum from about 400 nm (violet) to about 700 nm (red). For this purpose there are three types of sensors in the human eye. They have peak sensitivities at light frequencies labeled red (580 nm), green (540 nm), and blue (450 nm). The human perception of colors is a function of which combination of the three sensors is being excited and by how much.

The wavelength of light that elicits the strongest response for a light adapted human eye is at 555 nm. A light adapted eye is said to be operating in the photopic region (bright light). A dark adapted eye is said the operating in the scotopic region (dim light). The peak response of the human eye shifts from 555 nm to 510 nm as the ambient light decreases from a photopic to the scotopic region.

Figure 1:
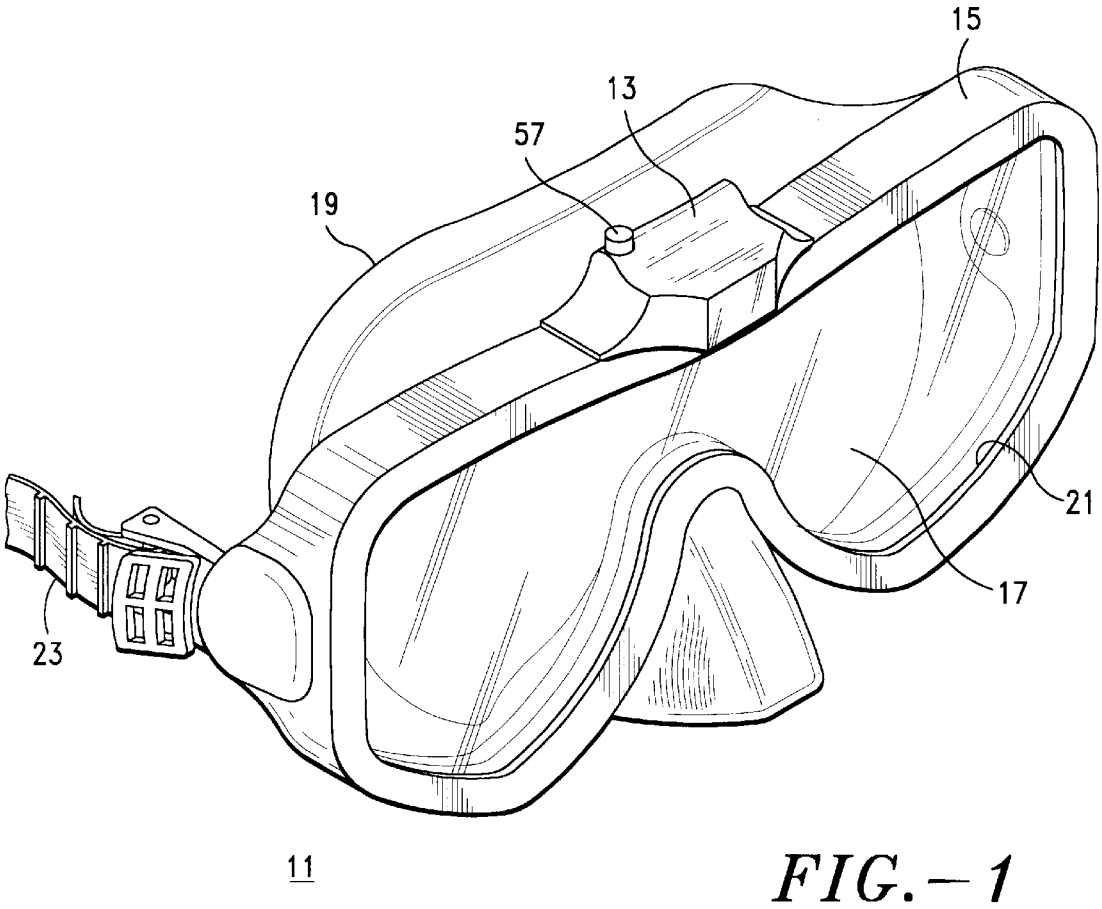
FIG. 1 is a perspective view of a preferred embodiment of the lighted mask of the present invention.

For an understanding of the invention, reference is made to the drawings for a description of the preferred embodiment of the present invention wherein like reference numbers represent like elements on corresponding views. FIG. 1 shows a dive mask 11 for underwater divers which includes apparatus 13 formed integral thereto for providing self-contained monochromatic illumination underwater. The dive mask is essentially identical to any standard dive mask except for the addition of the illumination apparatus.

In the preferred embodiment of the invention, the illumination apparatus 13 is preferably formed as an integral unit to the mask 11. Alternatively, a self-contained illumination unit can be secured to any design mask or made detachable from a special design mask formed to accommodate the self-contained apparatus. As a result, it is possible to make the apparatus adaptive to existing masks by employing an adequate attachment or securement means for a separable or permanently attachable illumination apparatus. Likewise, it is possible to integrate the illumination apparatus of the present invention into any preferred design of dive mask during its manufacture with at most only minor modifications to the molding of the flexible frame 15 of the mask.

As with most dive masks, a hardened glass, polycarbonate, or plastic view lens 17 is mounted in a rubber or plastic frame 15 which supports the lens on the divers face. The frame has a seal skirt 19 which is flexible and designed for enclosing the diver's eyes and positioning the lens at a preferential distance and orientation in front thereof. A lens seal 21 in the frame is disposed at the periphery of the glass lens, and the seal skirt 19 attaches to or is molded integral to the lens seal for providing water tight seals both around the lens and on the divers face around the divers eyes and usually underneath the diver's nose on his upper lip. The flexible frame is generally held in position on the diver's face by an elastic band 23 which encircles the back of the diver's head.

The illumination apparatus 13 is secured or mounted on the lens seal 21 of the flexible frame 15. In the preferred embodiment of the invention, a light source 25 comprised of a multiple of light emitting diodes (LEDs) 27 is mounted in the periphery of the lens frame 15 at the top thereof adjacent to each other. Lenses are provided to focus the light emitted by the LEDs. The essentially contiguous placement of the LEDs gathers the emitted light in effect to a point source and has a multiplying effect which increases the light projected forward.

Figure 2:
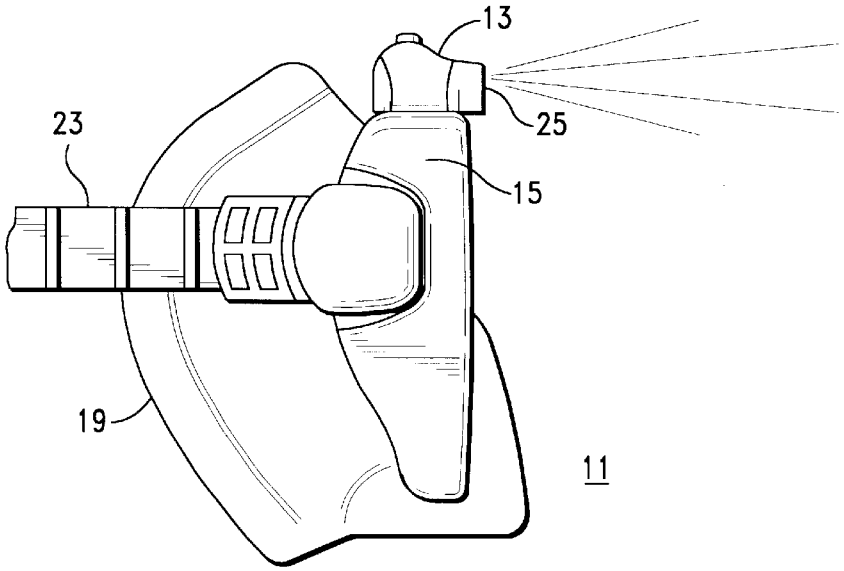
FIG. 2 is a end elevation thereof.

Reference is made to FIG. 2 which illustrates by the diverging lines radiating from the LEDs the direction in which the illumination from the light source 25 is directed by virtue of lenses associated with the LEDs and the preferred placement of the light source on the mask.

The LED light source 25 is preferably positioned on the mask above the diver's eyes, and the unitary arrangement simplifies the battery containment, electrical wiring requirements, and LED mounting on the mask. Alternatively, a pair of light sources could be separately located at positions on the mask alongside or outside of the diver's eyes in separate mounts with a centrally located or separate battery packs.

LEDs which emit light between 425 and 575 nm will provide light in the desired blue-green range. Underwater, in sea water, light in this range becomes monochromatic, and light in this range produces a very bright illumination source because of its ability to penetrate the sea water. LEDs are now being manufactured which can produce light at 540 nm; near very center of the "optical window" of sea water.

Figure 3:
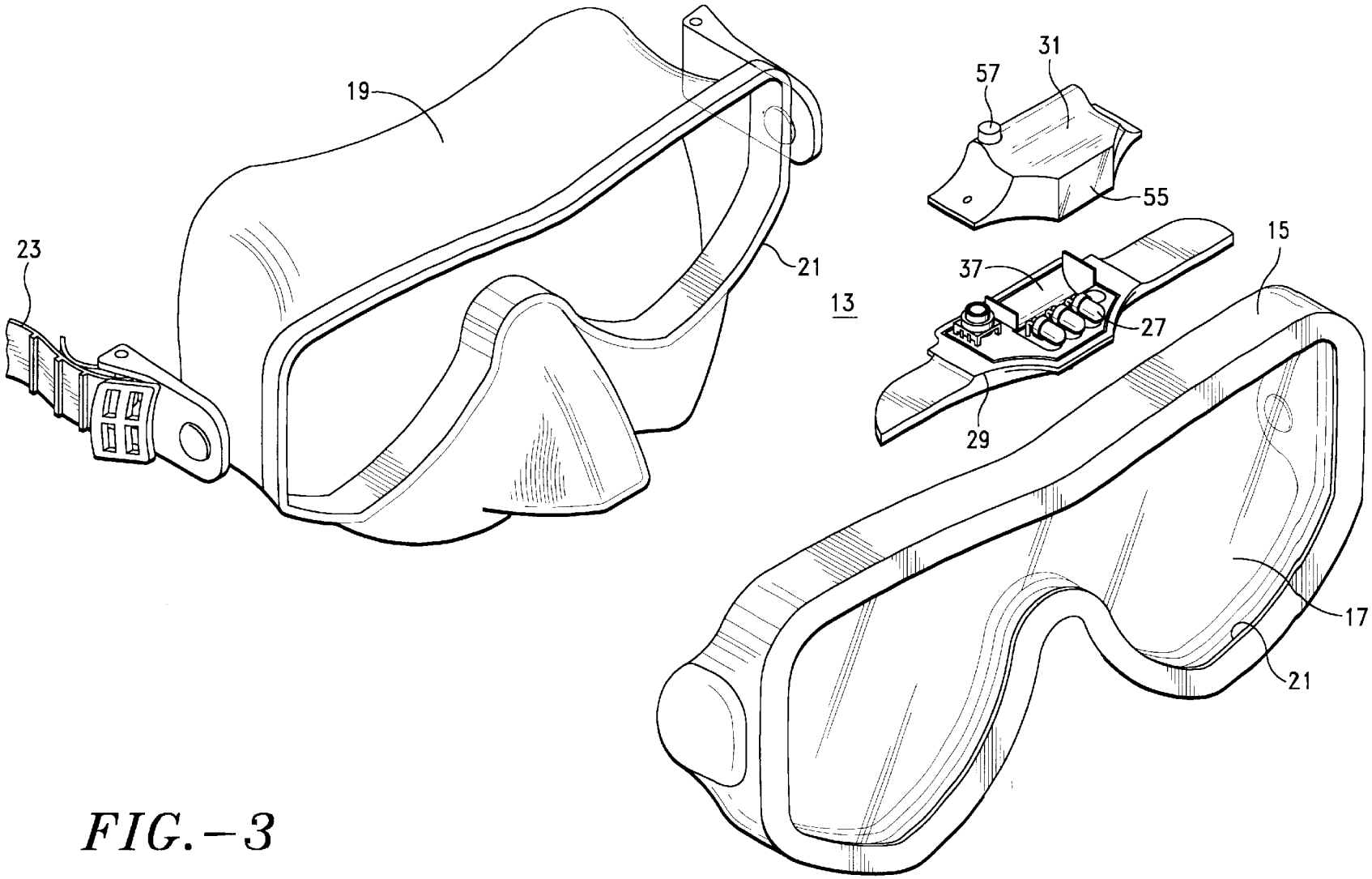
FIG. 3 is an exploded view thereof.

In a preferred embodiment of the invention, as shown in FIGS. 1–3, a separate illumination source unit 13 consisting of two parts as seen in FIG. 3 can be attached to or molded into the dive mask frame 15. A first or lower unit portion 29 is the frame attachment element. The attachment element can be molded integral to, glued, or electronically welded to the mask frame, or it can be made detachable by snap fittings, hook and loop fabric fasteners, or other detachable connections. A second or upper unit portion 31 serves as a waterproof cover for the attachment element. An electronics board is provided which includes the LEDs mounted thereon, a push button on/off switch, a battery tray, and the electrical connections. In the preferred embodiment of the invention, the electronics board is located in the first or lower portion of the unit, but it can be secured to either the upper or lower unit.

Figure 4:
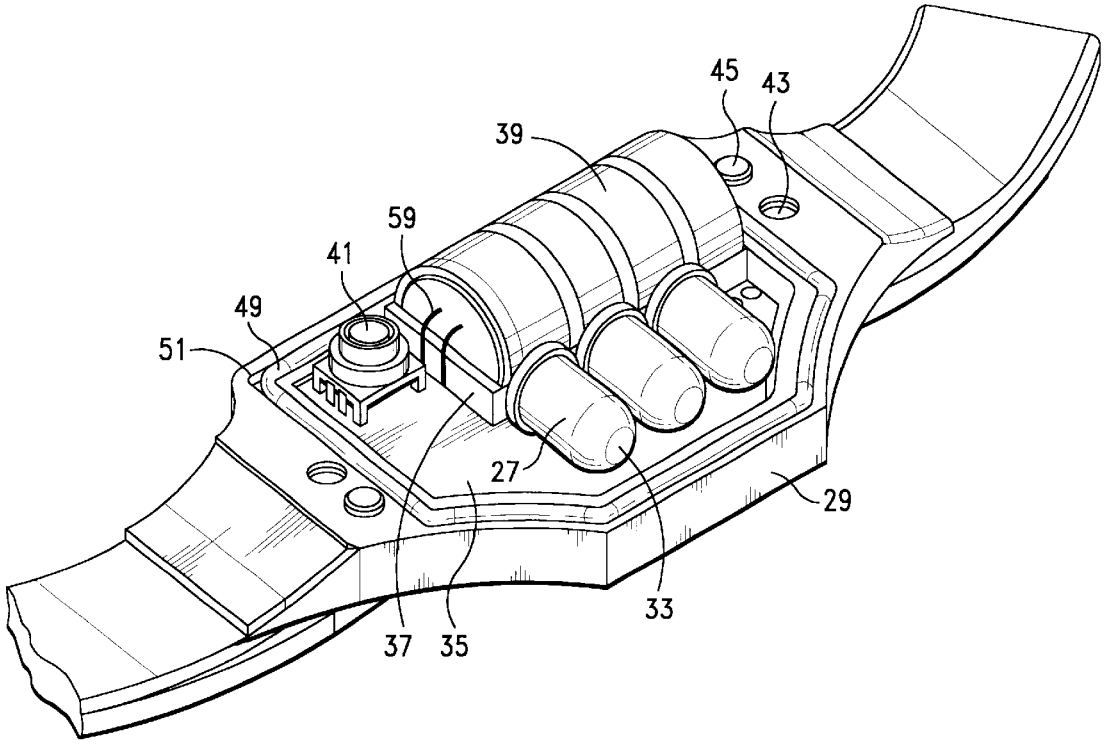
FIG. 4 is an enlarged perspective view of a preferred embodiment of the electrical components thereof.

At least one lens 33 seen in FIG. 4 is mounted in front of each LED of the light source 25 and formed to direct the emitted light to the area in front of the mask 11. In a preferred embodiment of the invention, separate lenses are utilized for each LED, and the LEDs 27 are aligned to focus collectively whereby the light source is focused in the direction the mask wearer is looking. It is conceivable that the lens could consist of a fiber optic cable or tube to direct light from recessed LEDs to the desired emission site and point it in the desired direction.

In the preferred embodiment of the invention, the lenses 33 are provided integral to the light source since the separate LEDs 27 can be manufactured encapsulated in a lens. Because the LEDs are self-contained, water tight, pressure resistant, miniature bulbs, they can be mounted in the mask frame 15 with no reflectors or pressure seals for the bulbs. For a mask having integral light source designed into the mask frame, the construction of the frame could include LED receptacles formed as molded recesses at the top/front thereof and the LED bulbs force fitted into the electrical receptacles and thereby automatically oriented to direct the light to the front of the mask 11. The bulbs can be held and sealed in position with respect to the electrical connections by friction fits in the respective receptacles. The electrical wiring can be embedded in the frame and a power source mounted in the mask frame electrically connected to the LEDs. In the preferred embodiment of the invention, however, the LEDs are sealed in a watertight container.

Shown in the exploded view of FIG. 3 of the drawings, and partially in the enlarged view of FIG. 4, are the first and second elements 29, 31 of the LED illumination source 13 which can be permanently or detachably mounted on top of the lens frame 15 of the mask 11. The second or upper portion 31 of the apparatus preferably consists of a removable cap which secures to the electronics board 35 and battery container 37 bottom portion to hold and seal the batteries 39 in the battery case. It can be removed in order to replace any or all of the batteries, the LEDs 27, the switch 41, or the electronics board.

Securement means at opposite ends of the case cap 31 can be used to hold the cap to the battery case lower unit 29.

Threaded receptacles 43 for receiving screws and male locating studs 45 are provided in the lower case. Female receptacles 47 for the male locating studs are located in the bottom surface of the upper unit or cap. An O-ring or bladder type seal 49 can be disposed in a formed recess 51 surrounding the periphery of the battery case 37 and electronics board 35 which deforms when the cap is secured in place to make the container watertight. The preferred embodiment of the case includes a matching male projection which mates with the recess surrounding the periphery of the battery case. However, the O-ring seal may be sufficient without the male-female seal or that seal may be sufficient without an O-ring. The front of the case 55, in front of the LEDs 27, is clear plastic to permit the light emitted from the LEDs to shine through.

Alternatively, one or more batteries 39 can be mounted in a water fight container and connected by embedded and insulated electrical wiring 59 to the LEDs 27. A receptacle or recess can be molded directly into the flexible mask frame 15 for retaining the battery container whereby when the flexible mask frame is distorted by stretching, the battery container can be inserted therein. When the stretched mask is released, the battery container is captured in the molded recess. Yet again, the battery container and an integral switch could be fitted into a pocket on the end of the frame whereby the push button of the switch could project through a side opening in the pocket. Yet again, pockets could be formed at both ends of the mask for containing the batteries so that the push button can be located on either side of the mask at the divers preference. The circuit assembly can be flipped over and reversed to place the push button at either side of the mask. The battery container can be permanently or detachably secured to the mask by glue or ultrasonic bonding or by mechanical means such as clips, hook and loop fasteners, snaps, or other attachment straps or devices. In the preferred embodiment of the invention, however, the batteries are located in a battery tray formed integral to the lower or first unit 29 of the illumination unit 13.

A switch means 41 is mounted on the mask 11 for electrically connecting the light source 13 to the power source 39. The switch means has modes for permitting intermittent operation of the light source as well as providing for the on and off modes of the light source. In the preferred embodiment of the invention, a standard three position push button switch serves the purpose. The first push position on the switch from the off mode initiates intermittent operation of the light source; the second push position on the switch turns the light source to the on mode: and the third push position on the switch returns the light source to the off mode. An electronic oscillator can be formed integral to the switch or in a separate control unit to provide the intermittent mode of operation of the light source. Multiple position switches could be used for other forms of operation including different speeds of intermittent operation and various flashing modes.

Intermittent operation of the LEDs 27 has a double benefit: it extends the life expectancy of the LEDs as well as conserving battery life. LEDs require considerably less power than an incandescent bulb and have many times the life thereof. Intermittent powering of the LEDs through a wide range of repetitive rates is sufficient to provide adequate light, and flashing of the LEDs at slower or coded rates can be a signal to another diver.

In the preferred embodiment of the invention, the switch means 41 for the power source is formed integral to the battery container 29, 31 and positioned so that when the battery container is secured to the flexible frame 15 of the mask 11, the switch means can be actuated by the diver simply pushing on a protruding button 57 integral to the battery box located on the face mask. While the battery box receptacle is preferably located top center on the mask frame, it can alternately be located at either of the lateral ends of the frame with the switch integral thereto. These positions locate the push button switch for convenient actuation by the diver when he wishes to change the electrical status of the light source.

The switch 41 is mounted on the molded electronics board to project through the top cover 31 and can be sealed in its extension therethrough by means such as O-rings. Alternatively, other switch means can be utilized such as an integral push button enclosed under a watertight deformable membrane in the battery container which is squeezed or pressed to actuate the electrical circuit. Other suitable switches can be located separate from the battery container in or on the mask and electrically connected to the battery container.

The electrical connection to the LEDs 27 is effected by embedded wires 59 which interconnect the LEDs in a parallel electrical circuit. The wires can be formed on the circuit board 35 which also serves to integrate the LED, batteries 39, switch 41, and wire elements into a separate removable assembly for easy replacement or service. The LEDs are securely mounted on the assembly and aimed in coordination to shine collectively through the clear lens 55 in the container.

The present invention also includes the method of providing self-contained illumination for underwater divers. It comprises providing a dive mask with at least one LED light source attached thereto. The LED emits monochromatic light between 425 and 575 nm. The light is directed to the area in front of the mask by means of a lens. A power source is provided interconnected to the LED light source, and a switch means is provided for controlling the on and off status of the light source.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A lighted mask for underwater divers comprising a frame for supporting a view lens and for positioning said mask on a diver's face and enclosing the diver's eyes, at least one LED forming a light source mounted on said frame and capable of emitting monochromatic light between 425 and 575 nm, focus means for gathering the light emitted from said light source and directing said light to the area in front of said mask in the direction the mask wearer is looking, a battery power source for said light source mounted in said mask and electrically connected to said light source, and a diver operable switch means mounted on said mask for electrically connecting said light source to said power source and for controlling the on and off status of said light source.

2. The lighted mask of claim 1 wherein at least one focusing lens is mounted in front of said light source for gathering said light to form a point source of illumination.

3. The lighted mask of claim 1 wherein said light source includes a multiple of LEDs emitting monochromatic light between 520 and 560 nm mounted in or on said frame of said mask each of said LEDs being encapsulated in a lens and being aligned to focus collectively.

4. The lighted mask of claim 3 wherein said LEDs are disposed at the top of said frame of said mask.

5. The lighted mask of claim 1 wherein said switch means is at least a three position push button switch formed integral to the container for said power source to provide on, off, and one or more flashing modes of operation.

6. The lighted mask of claims 5 wherein said push button switch means is mounted on the mask.

7. The lighted mask of claim 1 wherein said light source, said power source, and said switch means form an integral and self-contained removable unit which can be detachably secured to said frame of said mask.

8. The method of providing self-contained illumination for underwater divers comprising providing a dive mask having at least one LED light source attached thereto and emitting monochromatic light between 425 and 575 nm, directing said light to the area in front of said mask by means of a lens which gathers said light to focus it, securing one or more batteries electrically interconnected to said LED light source to said mask, and providing at least a three-position switch means for controlling the on and off status of said light source and initiating one or more flashing modes of operation.

9. A self-contained illumination unit for an underwater diver's mask comprising a watertight components container, at least one LED connected to said container and capable of emitting monochromatic light between 425 and 575 nm, a lens for gathering light from said LED and formed for directing it to the area in front of the diver's mask to which the illumination unit is attached, one or more batteries disposed in said container and electrically connected to said LED, a multiple position push button switch means secured to said container and operable by a diver for controlling the flow of electricity from said battery to said LED, and securement means for detachably affixing said illumination unit to a diver's mask in a position to permit said lens to direct light transmitted therethrough to be focused in the direction the diver is looking.

10. The illumination unit of claim 9 wherein said unit is formed integral to an underwater diver's face mask.

* * * * *